US009004623B2

(12) United States Patent
Koitzsch et al.

(10) Patent No.: US 9,004,623 B2
(45) Date of Patent: Apr. 14, 2015

(54) DOOR FOR A DOMESTIC APPLIANCE

(75) Inventors: Erhardt Koitzsch, Rothenburg (DE); Gerhard Schaff, Cadolzburg (DE); Dietmar Hildner, Furth (DE); Branko Ivanovic, Wurzburg (DE)

(73) Assignee: Electrolux Home Products Corporation N.V., Brussels (BE)

( * ) Notice: Subject to any disclaimer, the term of this patent is extended or adjusted under 35 U.S.C. 154(b) by 29 days.

(21) Appl. No.: 13/639,904

(22) PCT Filed: May 11, 2011

(86) PCT No.: PCT/EP2011/002332

§ 371 (c)(1), (2), (4) Date: Oct. 8, 2012

(87) PCT Pub. No.: WO2011/141166

PCT Pub. Date: Nov. 17, 2011

(65) Prior Publication Data

US 2013/0049559 A1 Feb. 28, 2013

(30) Foreign Application Priority Data

May 14, 2010 (EP) ..... 10005104

(51) Int. Cl.
*A47B 96/04* (2006.01)
*F24C 15/04* (2006.01)

(52) U.S. Cl.
CPC ..... *F24C 15/045* (2013.01)

(58) Field of Classification Search
CPC ..... G06F 1/185; F24C 15/04; A47B 88/06
USPC ..... 312/109, 265.6, 326–329, 400, 410; 126/190, 189, 200
See application file for complete search history.

(56) References Cited

U.S. PATENT DOCUMENTS

2005/0179351 A1* 8/2005 Bassi ..... 312/408
2007/0251520 A1* 11/2007 Bang ..... 126/200

FOREIGN PATENT DOCUMENTS

| | | |
|---|---|---|
| DE | 29912626 | 9/1999 |
| DE | 10336138 | 10/2004 |
| DE | 102006013521 | 11/2007 |
| EP | 1777462 | 4/2007 |

OTHER PUBLICATIONS

International Search Report for PCT/EP2011/002332, dated Jul. 21, 2011, 2 pages.

* cited by examiner

*Primary Examiner* — Matthew Ing
(74) *Attorney, Agent, or Firm* — Pearne & Gordon LLP

(57) ABSTRACT

A door for a domestic appliance, in particular for a cooking oven. The door comprises two door columns on the left hand side and on the right hand side of the door, an outer door panel at the outer sides of the door columns, an inner door panel at the inner sides of the door columns, and a cover frame for covering the top sides of the door columns and the inner door panel. In a mounted state the cover frame is fastened on the door columns, and the inner door panel is clamped by the cover frame. In an intermediate state the cover frame is fastened at the door columns in another position as in the mounted state, so that the inner door panel is removable from the inner sides of the door columns. Further, a corresponding domestic appliance with at least one door.

9 Claims, 7 Drawing Sheets

DOOR FOR A DOMESTIC APPLIANCE

Figure 1A:
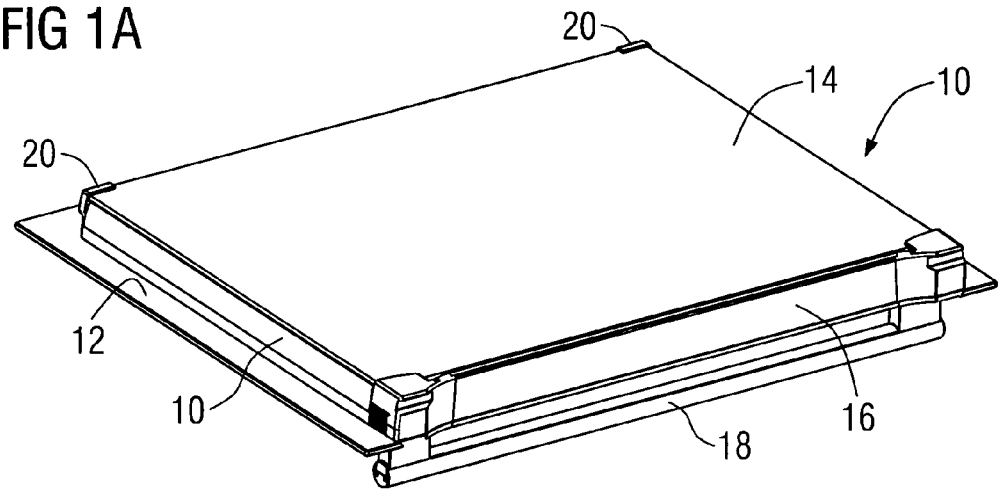

The present invention relates to a door for a domestic appliance according to the preamble of claim 1. Further, the present invention relates to a domestic appliance with at least one door.

Domestic appliances, in particular cooking ovens, comprise doors with several door panels. The door panels are typically transparent in order to allow the intervisibility inside the domestic appliance. Between the door panels an air stream may be provided for cooling or heating purposes. If the domestic appliance generates high temperatures, then the door panels should limit the temperatures at the outer side of the door.

Sometimes the door panels should be removable or exchangeable. In particular an inner door panel of a cooking oven should be removable for cleaning. Normally the door panels can be removed, after at least one frame element of the door frame has been removed. Further, tools are required in order to remove the door panel.

It is an object of the present invention to provide an improved door for a domestic appliance, which allows an easy removal or exchange of at least the inner door panel.

The object of the present invention is achieved by a door for a domestic appliance according to claim 1.

According to the present invention in an intermediate state the cover frame is fastened at the door columns in another position as in the mounted state, so that the inner door panel is removable from the inner sides of the door columns.

The cover frame can be displaced between two positions with respect to the door columns, wherein the cover frame is fastened at the door columns in both positions. In the one position of the cover frame the inner door panel is in a stable state. In the other position of the cover frame the inner door panel is removable, although the cover frame is still fastened at the door columns. Thus, only the door panel itself has to be removed, but not further part of the door. The cover frame must be only displaced.

According to a preferred embodiment of the present invention in the mounted state the inner door panel is clamped between the cover frame and clamping elements arranged at the lower portions of each door columns.

Preferably, a first snap-in mechanism is provided between the cover frame and the door columns for fastening the cover frame at the door columns in the mounted state. In general, between the cover frame and the door columns are such fastening elements, which can be released and connected the user without any tools.

In a similar way, a second snap-in mechanism is provided between the cover frame and the door columns for fastening the cover frame at the door columns in the intermediate state.

For example, the first and second snap-in mechanisms comprise at least one hook element and at least one lug element in each case. The hook element can be released by pressing a releasing element. In particular, the releasing element and the hook element form a single-piece part. Alternatively, the releasing element may be a separate part besides the hook element.

In particular, the hook element is arranged at the cover frame and the corresponding lug element is arranged at the door column.

Alternatively, the hook element is arranged at the door column and the corresponding lug element is arranged at the cover frame.

Preferably, at least one spring element is arranged between the cover frame and the door column in each case. For example, the spring element includes at least one coil spring.

Further, the door comprises at least one central door panel arranged between the outer door panel and the inner door panel. For example, the at least one central door panel is arranged between the both door columns. Also the central door panel may be removed, when the cover frame is in the intermediate state.

At last the present invention relates to a domestic appliance comprising at least one door as described above.

Novel and inventive features of the present invention are set forth in the appended claims.

Figure 2A:
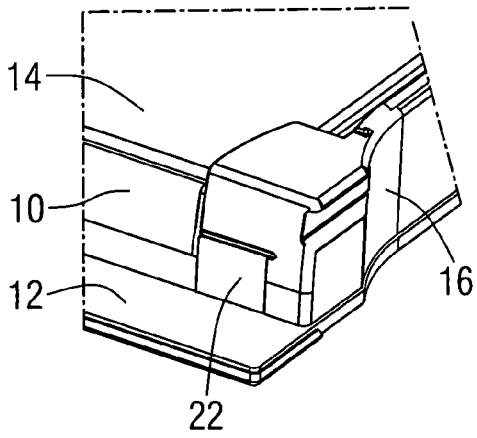
Figure 2B:
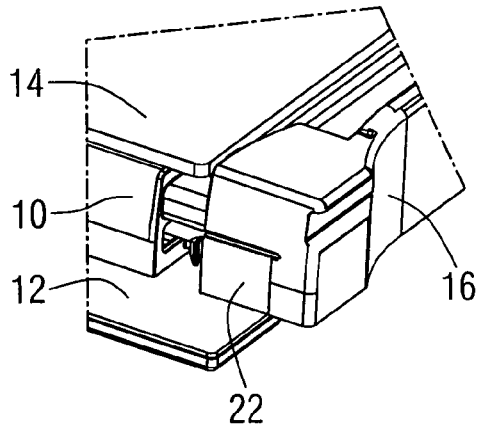
Figure 2C:
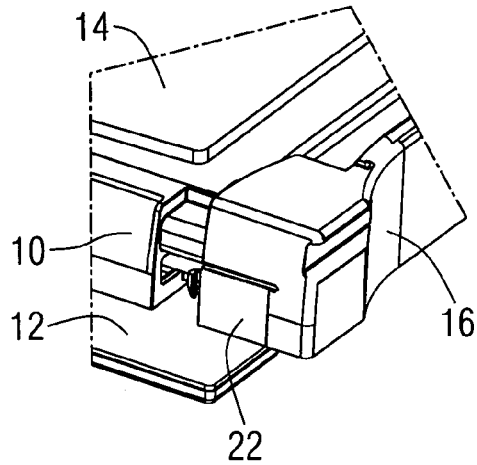
Figure 3:
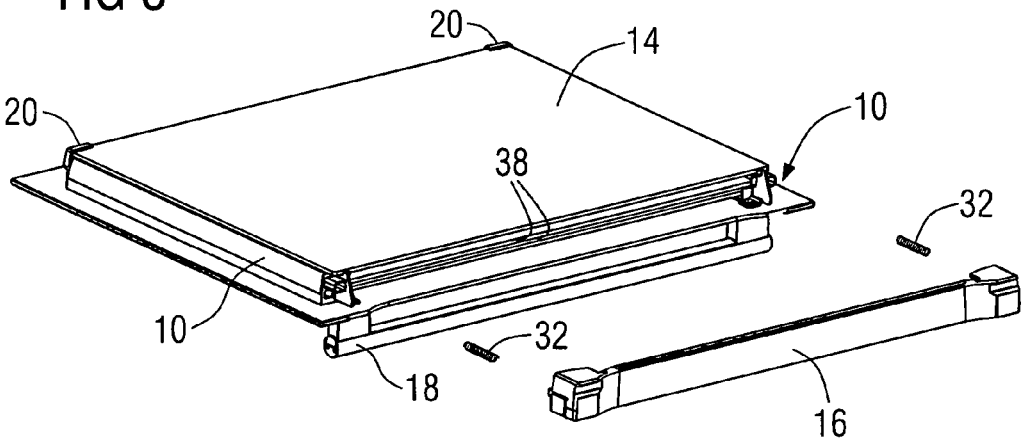
Figure 4:
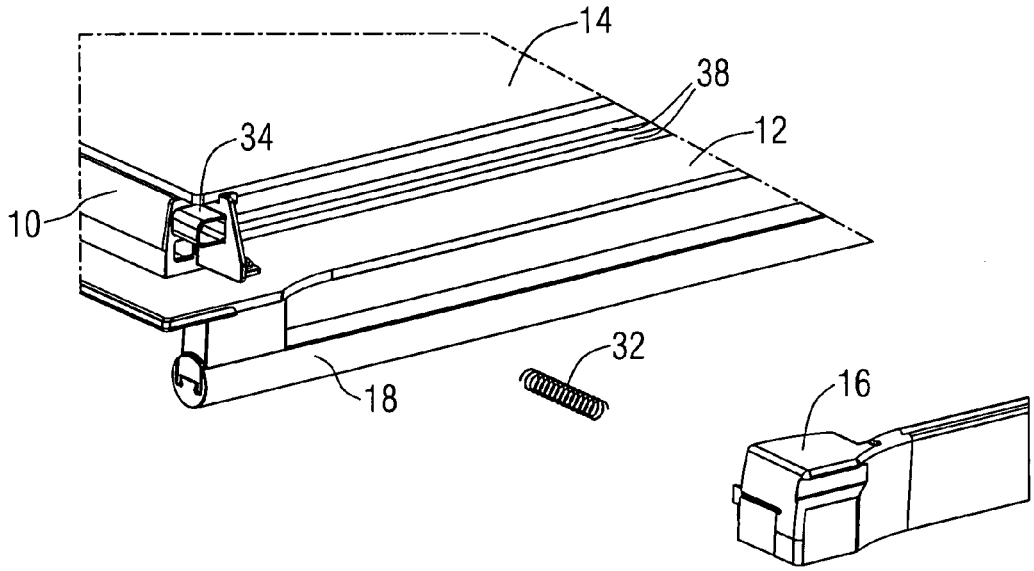
Figure 5:
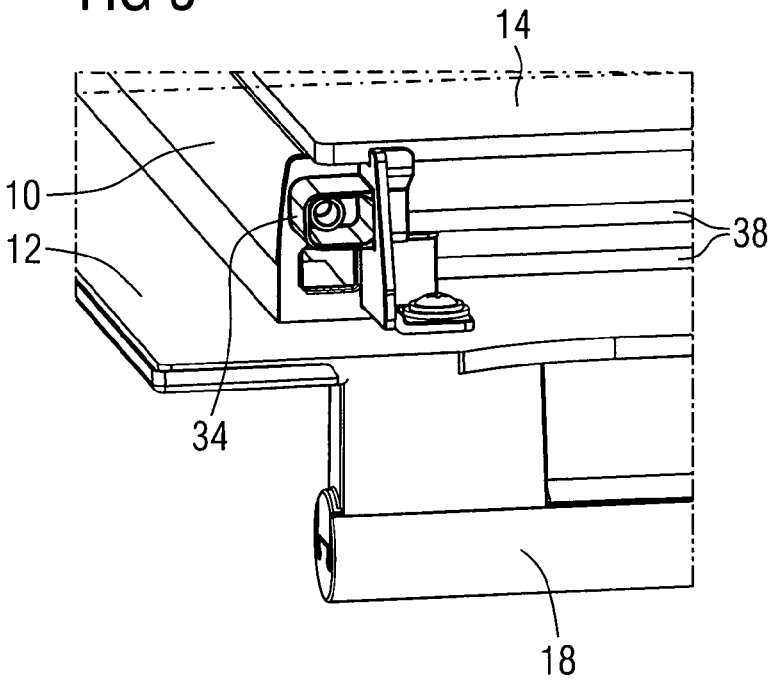
Figure 6:
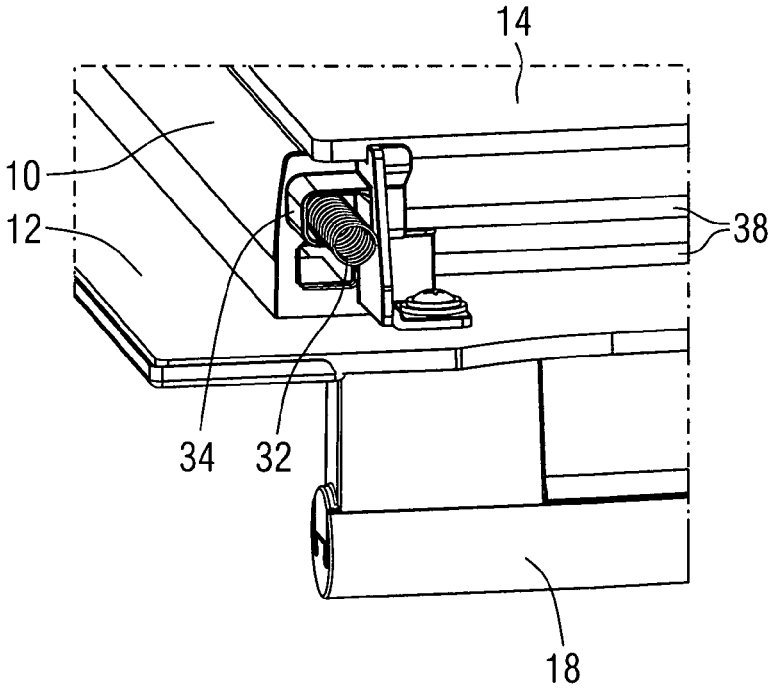
Figure 7:
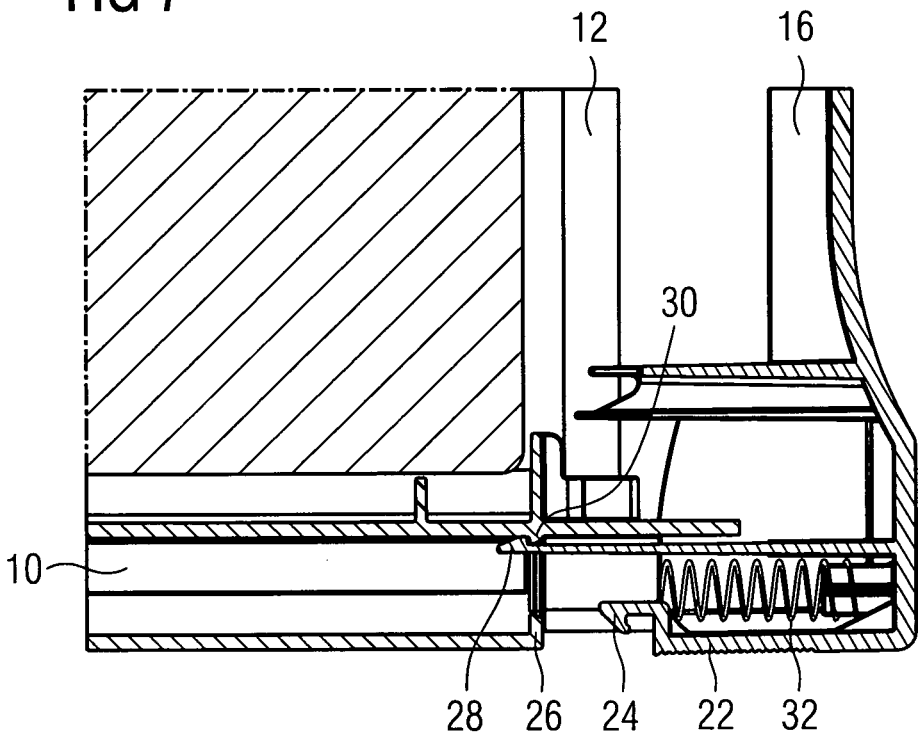
Figure 8:
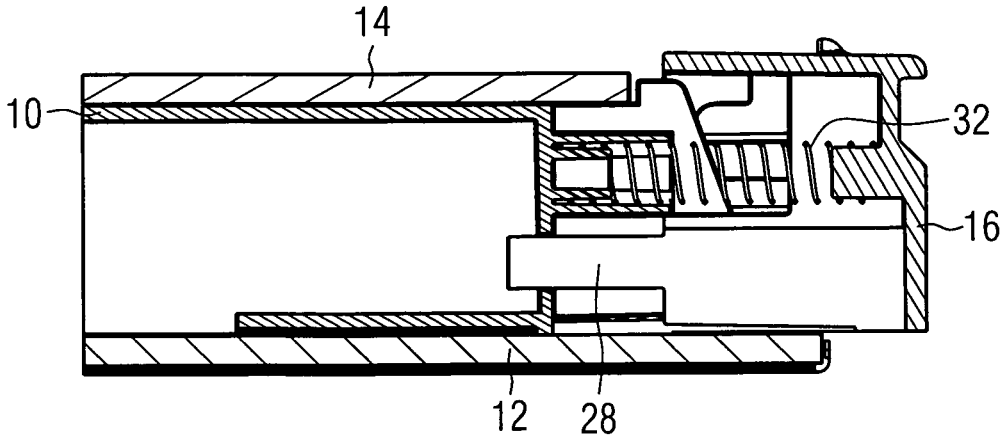
Figure 9:
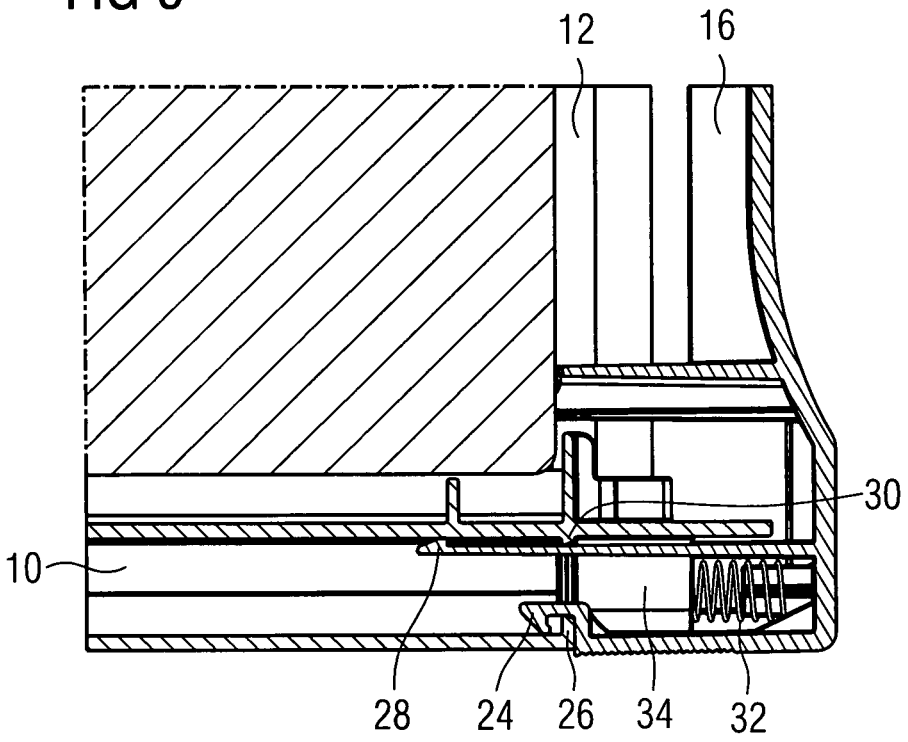
Figure 10:
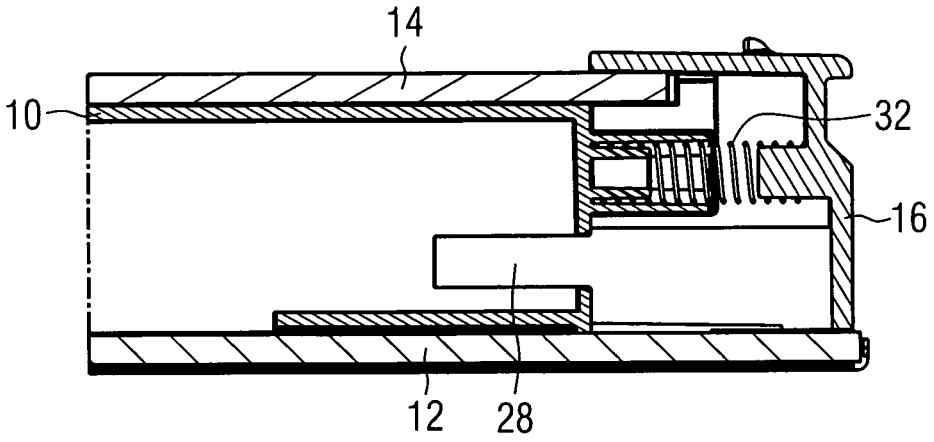

The present invention will be described in further detail with reference to the drawings, in which FIG. 1 illustrates three perspective views of different states of a door for a domestic appliance according to a preferred embodiment of the present invention, FIG. 2 illustrates three detailed perspective views of the different states of the door for the domestic appliance according to the preferred embodiment of the present invention, FIG. 3 illustrates a perspective view of a demounted state of a cover frame for the door according to the preferred embodiment of the present invention, FIG. 4 illustrates a detailed perspective view of the demounted state of the cover frame for the door according to the preferred embodiment of the present invention, FIG. 5 illustrates a detailed perspective view of a top side of a door column at the door according to the preferred embodiment of the present invention, FIG. 6 illustrates a detailed perspective view of the top side of the door column with a spring element at the door according to the preferred embodiment of the present invention, FIG. 7 illustrates a partial sectional front view of a cover frame in an intermediate state at the door column of the door according to the preferred embodiment of the present invention, FIG. 8 illustrates a sectional side view of the cover frame in the intermediate state at the door column of the door according to the preferred embodiment of the present invention, FIG. 9 illustrates a partial sectional front view of the cover frame in the mounted state at the door column of the door according to the preferred embodiment of the present invention, FIG. 10 illustrates a sectional side view of the cover frame in the mounted state at the door column of the door according to the preferred embodiment of the present invention, and FIG. 11 illustrates three partial detailed perspective views of the cover frame in a demounted state for the door according to the preferred embodiment of the present invention.

Figure 1B:
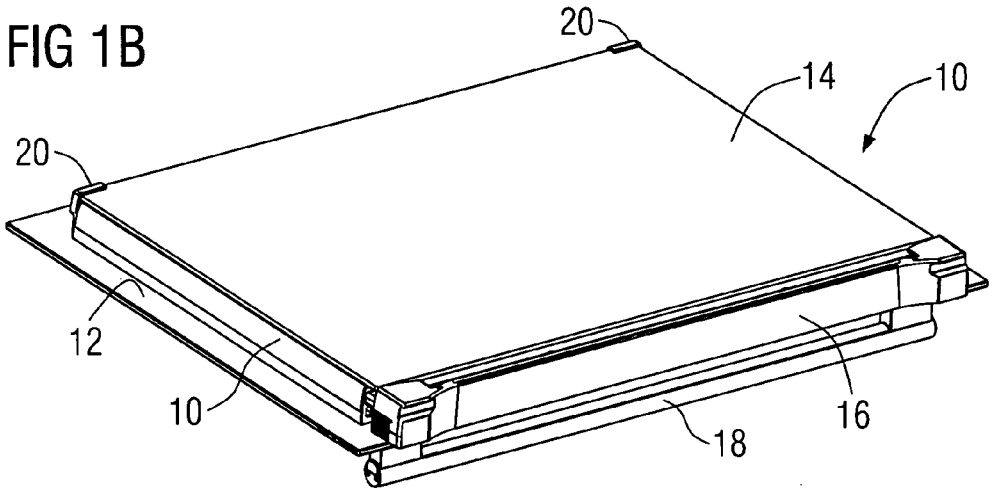
Figure 1C:
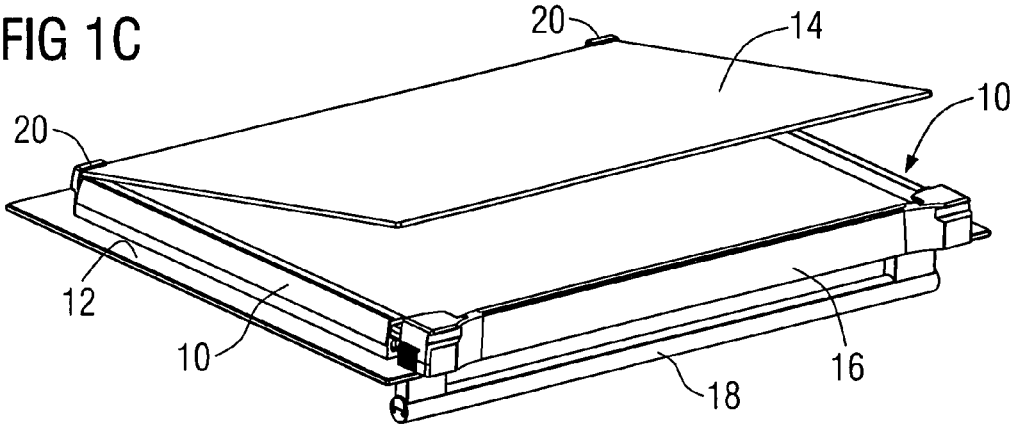

FIG. 1 illustrates three perspective views of different states of a door for a domestic appliance according to a preferred embodiment of the present invention. FIG. 1 includes the perspective views FIG. 1A, FIG. 1B and FIG. 1C.

FIG. 1 shows the door in a horizontal position. In a closed state of the domestic appliance the door is arranged vertically at said domestic appliance. In an open state the door is substantially in the horizontal position. Geometric relationships, like "high", "low", "left" or "right", in this description relate to the door in the vertical state.

The door comprises two door columns 10, an outer door panel 12, an inner door panel 14, a cover frame 16 and a door handle 18. The both door columns 10 are arranged at the left hand side and at the right hand side of the door. The door columns 10 are longitudinal profile elements. In the closed state of the door the door columns 10 are arranged vertically.

The outer door panel 12 is attached at the long front sides of the door columns 10. The outer door panel 12 covers the door columns 10 completely. A door handle 18 is attached at the outer side of the outer door panel 12.

The inner door panel 14 is attached at the long rear sides of the door columns 10. The area of the inner door panel 14 is smaller than the area of the outer door panel 12. A clamping element 20 is arranged at the lower end of each door column 10.

The clamping element 20 is provided for clamping the inner door panel 14 between the cover frame 16 and said clamping elements 20.

In FIG. 1A the cover frame 16 is in a mounted state. The cover frame 16 is snapped-in at the upper ends of the door columns 10. The inner door panel 14 is clamped between the cover frame 16 and the both clamping elements 20.

In FIG. 1B the cover frame 16 is an intermediate state. The cover frame 16 is snapped-in at the door columns 10 in a higher position as in the mounted state. The inner door panel 14 is lying on the rear sides of the door columns 10. Thus, the inner door panel 14 is now removable and can be picked-up by the user.

In FIG. 1C the cover frame 16 is the intermediate state. The inner door panel 14 is just removed from the rear sides of the door columns 10. In this intermediate state the inner door panel 14 can be removed from the door, but the cover frame 16 is still fastened at the door columns 10.

FIG. 2 illustrates three detailed perspective views of the different states of the door for the domestic appliance according to the preferred embodiment of the present invention. FIG. 2 includes the perspective views FIG. 2A, FIG. 2B and FIG. 2C.

The detailed perspective views show an upper left corner of the door. FIG. 2A, FIG. 2B and FIG. 2C correspond with FIG. 1A, FIG. 1B and FIG. 1C, respectively. Thus, FIG. 2A shows the mounted state of the cover frame 16, and FIG. 2B and FIG. 2C show the intermediate state of the cover frame 16.

A releasing element 22 is arranged at the outer side of the cover frame 16. By pressing the releasing element 22 a first snap-in mechanism between the cover frame 16 and the door column 10 is disconnected. The first snap-in mechanism connects the cover frame 16 to the door column 10 in the mounted state. In FIG. 1A the first snap-in mechanism is activated.

A second snap-in mechanism is provided for connecting the cover frame 16 to the door column 10 in the intermediate state. In FIG. 1B and FIG. 1C the second snap-in mechanism is activated. The second snap-in mechanism fixes the cover frame 16 at the door column 10, wherein the inner door panel 14 can be removed.

FIG. 3 illustrates a perspective view of a demounted state of the cover frame 16 for the door according to the preferred embodiment of the present invention.

In FIG. 3 the door frame 16 is completely removed from the door and from the door columns 10. The inner door panel 14 is lying on the door columns 10 without a stable fixation.

Between the cover frame 16 and each of the door columns 10 a spring element 32 is shown. The spring element 32 is provided as an elastic member between the cover frame 16 and the door column 10 in order to support the first snap-in mechanism.

In this example two central door panels 38 are arranged between the door columns 10. Further, the central door panels 38 are arranged between the outer door panel 12 and the inner door panel 14.

FIG. 4 illustrates a detailed perspective view of the demounted state of the cover frame 16 for the door according to the preferred embodiment of the present invention. FIG. 4 shows in detail the cover frame 16, the door column 10 and the spring element 32. A receiving element 34 is arranged at the top side of the door column 10. The receiving element 34 is provided for receiving the spring element 32.

FIG. 5 illustrates a detailed perspective view of a top side of the door column 16 at the door according to the preferred embodiment of the present invention. The receiving element 34 is complementary to the end portion of the spring element 32.

FIG. 6 illustrates a detailed perspective view of the top side of the door column 16 with the spring element 32 for the door according to the preferred embodiment of the present invention. In FIG. 6 the spring element 32 is inserted in the receiving element 34.

FIG. 7 illustrates a partial sectional front view of the cover frame 16 in the intermediate state at the door column 10 of the door according to the preferred embodiment of the present invention.

The cover frame 16 comprises a first hook element 24 and a second hook element 28. The door column 10 comprises a first lug element 26 and a second lug element 30. The first hook element 24 and the first lug element 26 form the first snap-in mechanism. The second hook element 28 and the second lug element 30 form the second snap-in mechanism.

The first lug element 26 and the second lug element 30 are arranged at the upper end of the door column 10 at the same level. The first hook element 24 is shorter than the second hook element 28. Thus, the second hook element 28 can penetrate deeper in to the door column 10 than the first hook element 24. The second snap-in mechanism is activated, since the second hook element 28 is connected to the second lug element 30. The first snap-in mechanism is deactivated, since the first hook element 24 is not connected to the first lug element 26. The first hook element 24 can be operated by touching the releasing element 22.

The cover frame 16 is fastened at the door column 10 by the second snap-in mechanism.

FIG. 8 illustrates a sectional side view of the cover frame 16 in the intermediate state at the door column 10 of the door according to the preferred embodiment of the present invention.

In the intermediate state the cover frame 16 is fastened at the door column 10 by the second snap-in mechanism. FIG. 8 clarifies that the inner door panel 14 can be removed in the intermediate state.

FIG. 9 illustrates a partial sectional front view of the cover frame 16 in the mounted state at the door column 10 of the door according to the preferred embodiment of the present invention.

In the mounted state the first snap-in mechanism is activated, since the first hook element 24 is connected to the first lug element 26. The cover frame 16 is fastened at the door column 10 by the first snap-in mechanism. Otherwise, the second snap-in mechanism is deactivated, since the second hook element 28 is not connected to the second lug element 30.

FIG. 10 illustrates a sectional side view of the cover frame 16 in the mounted state at the door column of the door according to the preferred embodiment of the present invention.

In the mounted state the cover frame 16 is fastened at the door column 10 by the first snap-in mechanism. FIG. 10 clarifies that the inner door panel 14 is clamped by the cover frame 16 in the mounted state.

FIG. 11 illustrates three partial detailed perspective views of the cover frame 16 in a demounted state for the door according to the preferred embodiment of the present invention.

Figure 11A:
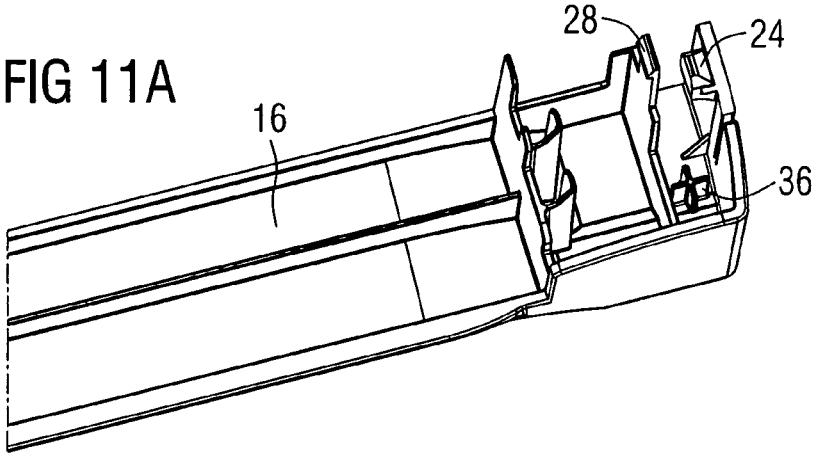
Figure 11B:
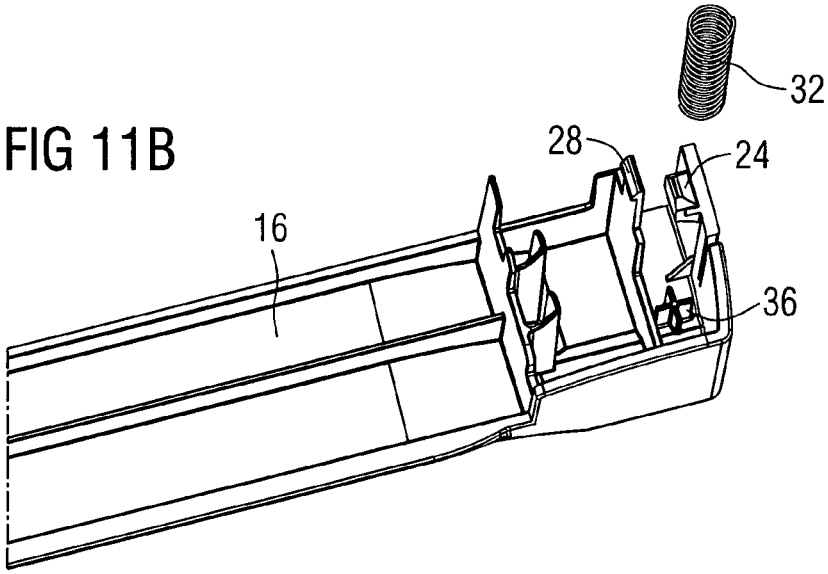
Figure 11C:
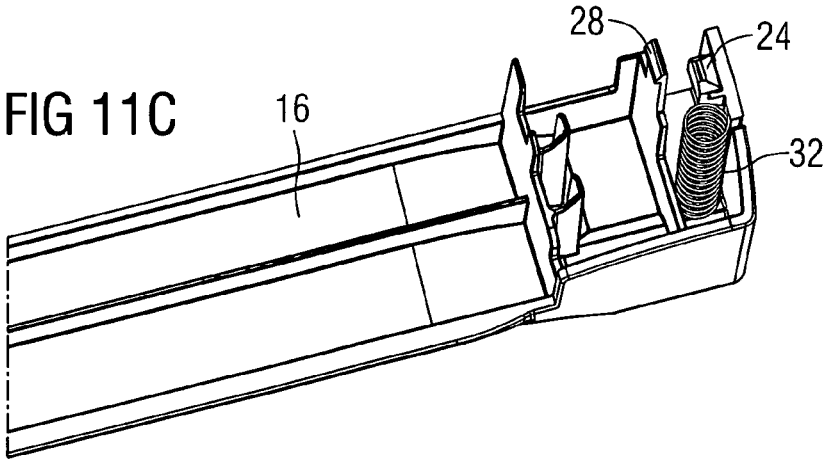

FIG. 11 shows the lower side of an end portion of the cover frame 16. The lower side of said end portion is provided to be connected to the upper end of one of the door columns 10. FIG. 11 clarifies the arrangement of the spring element 32 within the cover frame 16. FIG. 11 includes the detailed perspective views FIG. 11A, FIG. 11B and FIG. 11C.

FIG. 11A shows the cover frame 16 without the spring element 32. The cover frame 16 includes a pin element 36 for receiving the spring element 32.

FIG. 11B illustrates the cover frame 16 and the spring element 32, wherein the spring element 32 is displaced along its longitudinal axis in relation to its provided position at the pin element 36.

FIG. 11C shows the cover frame 16 and the spring element 32, wherein the spring element 32 is placed in the provided position. The pin element 36 extends into a part of the spring element 32.

The spring element 32 is clamped between the pin element 36 of the cover frame 16 and the receiving element 34 of the door column 10 in the mounted state as well as in the intermediate state.

Although an illustrative embodiment of the present invention has been described herein with reference to the accompanying drawings, it is to be understood that the present invention is not limited to this precise embodiment, and that various other changes and modifications may be affected therein by one skilled in the art without departing from the scope or spirit of the invention. All such changes and modifications are intended to be included within the scope of the invention as defined by the appended claims.

List of Reference Numerals

10 door column
12 outer door panel
14 inner door panel
16 cover frame
18 door handle
20 clamping element
22 releasing element
24 first hook element
26 first lug element
28 second hook element
30 second lug element
32 spring element
34 receiving element
36 pin element
38 central door panel

The invention claimed is:

1. A door for a cooking oven, wherein the door comprises:

two door columns (10) on the left hand side and on the right hand side of the door, an outer door panel (12) at the outer sides of the door columns (10), an inner door panel (14) at the inner sides of the door columns (10), and a cover frame (16) for covering the top sides of the inner door panel (14) and the door columns (10), wherein in a mounted state the cover frame (16) is fastened on the door columns (10), and the inner door panel (14) is clamped by the cover frame (16), in an intermediate state the cover frame (16) is fastened at the door columns (10) in another position as in the mounted state, so that the inner door panel (14) is removable from the inner sides of the door columns (10), a first snap-in mechanism (24, 26) is provided between the cover frame (16) and the door columns (10) for fastening the cover frame (16) at the door columns (10) in the mounted state, and the first snap-in mechanism (24, 26) comprises at least one hook element (24) and at least one lug element (26).

2. The door according to claim 1, characterized in, that in the mounted state the inner door panel (14) is clamped between the cover frame (16) and clamping elements (20) arranged at the lower portions of each door column (16).

3. The door according to claim 1, characterized in, that a second snap-in mechanism (28, 30) is provided between the cover frame (16) and the door columns (10) for fastening the cover frame (16) at the door columns (10) in the intermediate state.

4. The door according to claim 1, characterized in, that the hook element (24) is arranged at the cover frame (16) and the corresponding lug element (26) is arranged at the door column (10).

5. The door according to claim 1, characterized in, that the hook element (24) is arranged at the door column (10) and the corresponding lug element (26) is arranged at the cover frame (16).

6. The door according to claim 1, characterized in, that the door comprises at least one central door panel (38) arranged between the outer door panel (12) and the inner door panel (14).

7. The door according to claim 6, characterized in, that the at least one central door panel (38) is arranged between the both door columns (10).

8. A domestic appliance with at least one door, characterized in, that the domestic appliance comprises at least one door according to claim 1.

9. A door for a cooking oven, wherein the door comprises:

two door columns (10) on the left hand side and on the right hand side of the door, an outer door panel (12) at the outer sides of the door columns (10), an inner door panel (14) at the inner sides of the door columns (10), and a cover frame (16) for covering the top sides of the inner door panel (14) and the door columns (10), wherein in a mounted state the cover frame (16) is fastened on the door columns (10), and the inner door panel (14) is clamped by the cover frame (16), in an intermediate state the cover frame (16) is fastened at the door columns (10) in another position as in the mounted state, so that the inner door panel (14) is removable from the inner sides of the door columns (10), and at least one spring element (32) is arranged between the cover frame (16) and the door column (10) in each case.

* * * * *